US006252524B1

(12) United States Patent
Takikita

(10) Patent No.: US 6,252,524 B1
(45) Date of Patent: Jun. 26, 2001

(54) VEHICLE-MOUNTED UNIT FOR A TOLL COLLECTION SYSTEM

(75) Inventor: Mamoru Takikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/414,776

(22) Filed: Oct. 8, 1999

(30) Foreign Application Priority Data

Apr. 12, 1999 (JP) ..... 11-104372

(51) Int. Cl.[7] ..... G08G 1/01
(52) U.S. Cl. ..... 340/933; 235/384
(58) Field of Search ..... 340/933, 928, 340/937, 931, 932, 825.69, 825.72; 180/275, 277, 167, 169, 287, 288; 307/10.4; 235/384, 375

(56) References Cited

U.S. PATENT DOCUMENTS 3,794,966 * 2/1974 Platzman ..... 340/31 R
4,555,618 * 11/1985 Riskin ..... 235/384
5,177,462 * 1/1993 Kajiwara ..... 340/903
5,717,390 * 2/1998 Hasselbring ..... 340/933
5,933,096 * 8/1999 Tsuda ..... 340/933

FOREIGN PATENT DOCUMENTS 8-22594 1/1996 (JP) .

* cited by examiner

*Primary Examiner*—Daniel J. Wu
*Assistant Examiner*—John Tweel, Jr.
(74) *Attorney, Agent, or Firm*—Sughrue, Mion, Zinn, Macpeak & Seas, PLLC

(57) ABSTRACT

A vehicle-mounted unit for a toll collection system for automatically charging a toll comprises a communication zone determining means for determining if the vehicle is within a toll collection communication zone by radio communication with a road-side machine, an insertion state detecting means for detecting if the storage medium has been correctly inserted into the vehicle-mounted unit, a suitability determining means for determining if the storage medium is suitable for toll collection, and an external control apparatus interface portion for sending and receiving data signals to and from a vehicle speed control device, the interface portion sending data to the vehicle speed control device for decelerating the vehicle if the vehicle-mounted unit is within the toll collection communication zone and is confirming if the storage medium is correctly inserted into the vehicle-mounted unit or is confirming toll collection suitability.

8 Claims, 8 Drawing Sheets

VEHICLE-MOUNTED UNIT FOR A TOLL COLLECTION SYSTEM

BACKGROUND OF THE INVENTION

1. Field of the Invention

The present invention relates to a vehicle-mounted unit mounted to an automobile for a toll collection system using radio communication.

2. Description of the Related Art

Toll collection systems for toll roads aiming to make toll payment cashless and allow toll gates at entrances and exits to be automated, as well as enabling nonstop passage, are conventionally known.

In such toll collection systems, in order to make the system cashless, any of a variety of cards such as a bank card or a prepaid card, or a credit card or an IC card recorded with information to identify the user must be inserted into a vehicle-mounted unit. In such cases, the card is inserted into the vehicle-mounted unit and if the information stored on the card is suitable, the card can be used.

FIG. 9 is a block diagram showing the functional configuration of a vehicle-mounted unit representing a conventional vehicle-mounted unit.

In the diagram, a central processing unit (CPU) 2 is disposed in a vehicle-mounted unit 1, controlling a radio wave detector portion 5, a communication control portion 6, a storage medium interface portion 4, a card insertion detector switch 13 being a storage medium insertion detector portion, a memory 7, and a display portion 14. Power is supplied to these portions from a power source (not shown). The radio wave detector portion 5 detects the strength of a radio signal from a road-side machine (not-shown) by means of an antenna 11. The communication control portion 6 sends and receives data to and from the road-side machine by radio by means of the antenna 11. The storage medium interface portion 4 sends and receives data to and from an IC card 20 which is a storage medium. The memory 7 stores the information necessary for toll collection between the road-side machine and the IC card 20. The display portion 14 serves the function of conveying information concerning the toll collection results to the driver, and may comprise, for example, light emitting diodes, a liquid-crystal display, a voice generating device, etc. A storage medium insertion portion 12 for the insertion of the IC card 20 is also disposed in the vehicle-mounted unit 1. When the IC card 20 is inserted into the storage medium insertion portion 12, the card insertion detector switch 13 being a storage medium insertion detector portion is switched on and the CPU 2 receives a storage medium insertion confirmation signal.

A memory 22 capable of recording and holding the information necessary for toll collection, and a vehicle-mounted unit interface portion 21 for exchanging data with the vehicle-mounted unit 1 are disposed on the IC card 20.

In a toll collection system, a toll collection suitability check is performed by confirming whether the IC card 20 is correctly inserted into the storage medium insertion portion 12 of the vehicle-mounted unit 1, and comparing the information, such as the user ID, the expiration date of the IC card 20, etc., stored in advance in the memory 22 of the IC card 20 with the information stored in the memory 7 of the vehicle-mounted unit 1 to confirm if the IC card 20 is suitable for toll collection.

Furthermore, the radio wave detector portion 5 detects the strength of the radio signal from the road-side machine and confirms whether the radio signal is strong enough to enable the transmission of toll collection data between the road-side machine and the communication control portion 6, and if data transmission is possible, sends a signal to the CPU 2 indicating that the vehicle is within a toll collection communication zone.

In this manner, once the vehicle is within a toll collection communication zone and a toll collection suitability check of the IC card 20 has been completed, toll collection is performed. Consequently, once the toll collection suitability check of the IC card 20 has been completed, toll collection is performed immediately if the vehicle proceeds into a toll collection communication zone.

However, in a conventional toll collection system, the vehicle may approach a toll gate without the IC card having been inserted into the vehicle-mounted unit 1 and the vehicle may already be within the toll collection communication zone before the driver notices that the IC card 20 has not been inserted. In that case, even if the IC card 20 is then inserted, a certain amount of time is required to perform a toll collection suitability check of the IC card 20 and prepare the IC card 20 for use. That is to say, the time required to perform the series of actions in the toll collection suitability check, namely, initializing the IC card 20, reading the information from the memory 22 of the IC card 20, and confirming that the IC card is suitable for toll collection, is sufficiently large compared to the time the vehicle passes through the toll collection communication zone that it cannot be ignored. Consequently, one problem has been the possibility of circumstances arising in which a toll cannot be collected in time within a toll collection communication zone.

For example, if the toll collection communication zone is 10 m long, and the speed of the vehicle is 10 kph, it only takes 3.6 seconds to pass through the toll collection communication zone. The time required for a toll collection suitability check of a storage medium such as the IC card 20 depends on the transmission rate of the storage medium interface portion 4, for example, in the case of the IC card 20, a minimum of about one second is required on the whole for the CPU 2 to verify that the card is correctly inserted and to perform a toll collection suitability check of the IC card.

For that reason, when insertion of the IC card is delayed, the toll cannot be collected within the toll collection communication zone. Furthermore, even if the IC card 20 is hurriedly inserted into the vehicle-mounted unit 1, concern that toll collection will not be performed may lead to confusion in the driver's mental state. In addition, measures are then required at the toll gate for cases where toll collection is not possible such as installing means for inhibiting further movement of a vehicle on which toll collection cannot be performed.

On the other hand, the vehicle-mounted unit for an information transmission device indicated in Japanese Patent Laid-Open 8-22594 is a known example of a conventional vehicle-mounted unit for a toll collection system capable of preventing delayed insertion of cards such as the IC card 20. The device alerts the driver to the fact that the card has not been inserted.

However, the device merely urges the driver to insert the card, and if the driver does not insert the card swiftly, the vehicle still passes through the toll collection communication zone and toll collection cannot be performed.

SUMMARY OF THE INVENTION

The present invention aims to solve the above problems and an object of the present invention is to provide a vehicle-mounted unit for a toll collection system enabling toll collection to be performed reliably even if insertion of the storage medium by the driver is delayed.

In accordance with a first embodiment of the present invention, a vehicle-mounted unit for a toll collection system for performing radio communication with a road-side machine and automatically charging a toll based on information in a storage medium removably inserted into the vehicle-mounted unit comprises:

a communication zone determining means for determining if the vehicle is within a toll collection communication zone by radio communication with the road-side machine;

an insertion state detecting means for detecting if the storage medium has been correctly inserted into the vehicle-mounted unit;

a suitability determining means for determining if the storage medium is suitable for toll collection; and a data sending and receiving means connected to an external control apparatus for sending and receiving data signals to and from the external control apparatus, the data sending and receiving means sending data to the external control apparatus for decelerating the vehicle if the vehicle-mounted unit is within the toll collection communication zone and is confirming if the storage medium is correctly inserted into the vehicle-mounted unit or is confirming toll collection suitability.

In the vehicle-mounted unit for a toll collection system, the data sent from the data sending and receiving means includes a required speed for the vehicle.

In the vehicle-mounted unit for a toll collection system, the external control apparatus comprises a vehicle speed control device.

In the vehicle-mounted unit for a toll collection system, the external control apparatus comprises a navigation system.

In accordance with a second embodiment of the present invention, a vehicle-mounted unit for a toll collection system for performing radio communication with a road-side machine and automatically charging a toll based on information in a storage medium removably inserted into the vehicle-mounted unit comprises:

a communication zone determining means for determining if the vehicle is within a toll collection communication zone by radio communication with the road-side machine;

an insertion state detecting means for detecting if the storage medium has been correctly inserted into the vehicle-mounted unit;

a suitability determining means for determining if the storage medium is suitable for toll collection; and a display means activated in response to the communication zone determining means, the insertion state detecting means, and the suitability determining means, the display means creating a display urging the driver to decelerate the vehicle if the vehicle-mounted unit is within the toll collection communication zone and is confirming if the storage medium is correctly inserted into the vehicle-mounted unit or is confirming toll collection suitability.

In the vehicle-mounted unit for a toll collection system, the display means performs a display urging the driver to stop the vehicle if the storage medium is correctly inserted into the vehicle-mounted unit after the vehicle has entered the toll collection communication zone.

DETAILED DESCRIPTION OF THE PREFERRED EMBODIMENTS

Embodiment 1

Figure 1:
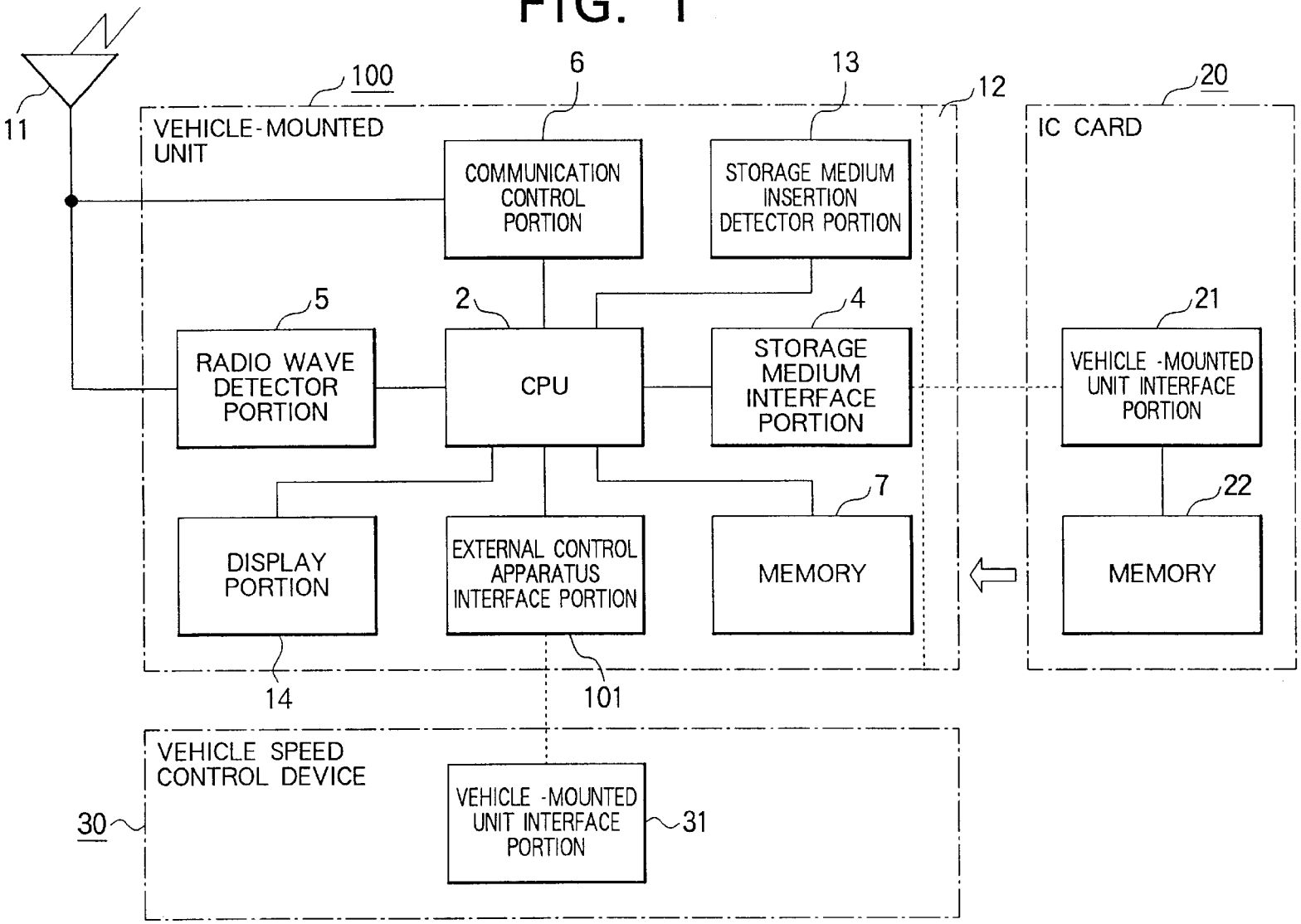
FIG. 1 is a block diagram showing the functional construction of the periphery of a vehicle-mounted unit for a toll collection system according to Embodiment 1 of the present invention.
Figure 9:
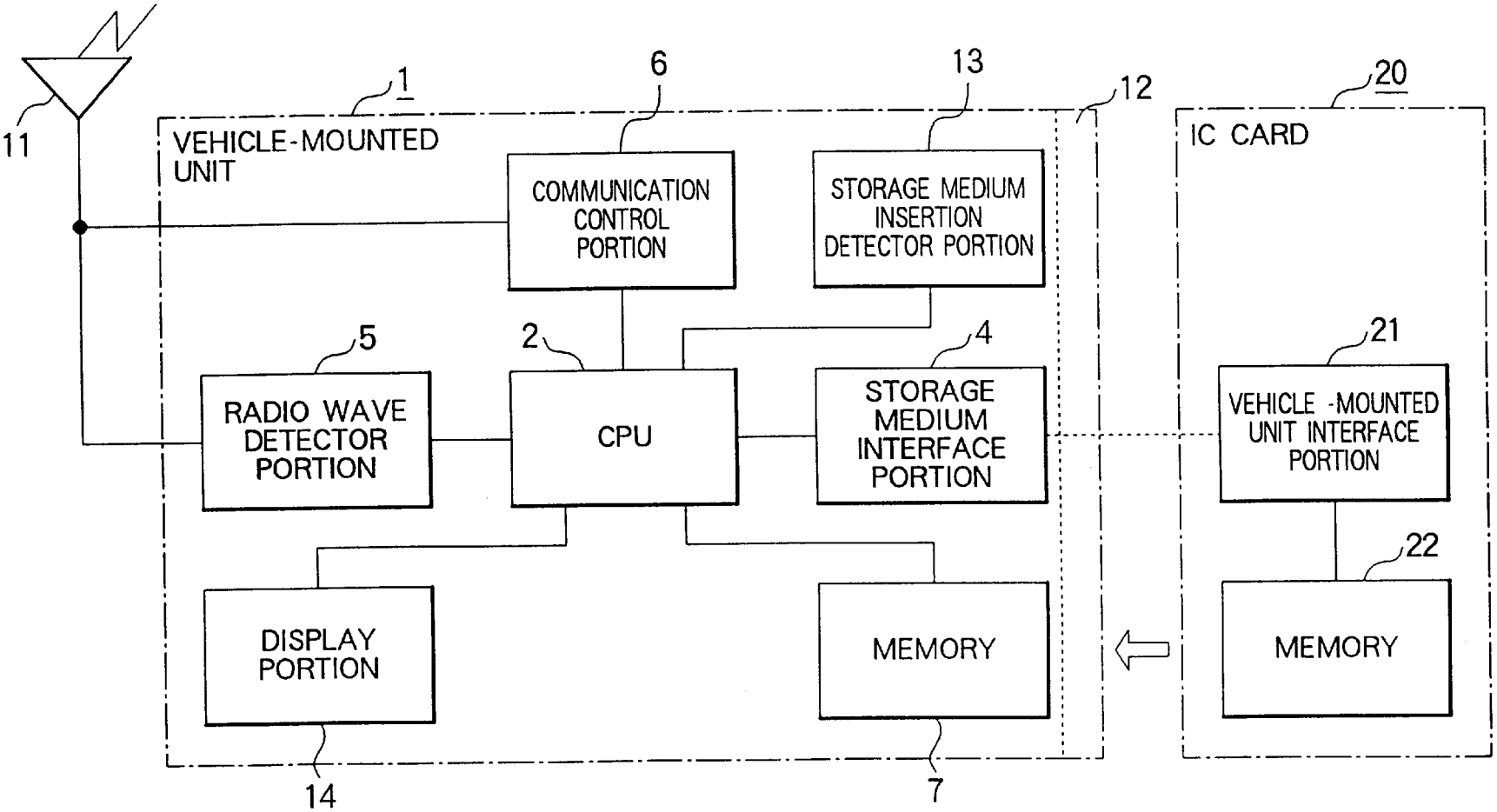
FIG. 9 PRIOR ART
FIG. 9 is a block diagram showing the functional construction of the periphery of a conventional vehicle-mounted unit for a toll collection system.

Embodiment 1 of the present invention will be explained below with reference to the drawings. FIG. 1 is a block diagram showing the functional construction of the periphery of a vehicle-mounted unit mounted to an automobile in a toll collection system according to Embodiment 1 of the present invention. FIG. 1 differs from FIG. 9 in that a vehicle speed control device is connected to the vehicle-mounted unit.

A CPU 2 is disposed in the vehicle-mounted unit 100 mounted to an automobile, connected to and controlling a radio wave detector portion 5 and a communication control portion 6 for performing radio communication with a road-side machine, a storage medium interface portion 4, a card insertion detector switch 13 being a storage medium insertion detector portion, an external control apparatus interface portion 101, a memory 7, and a display portion 14. Power is supplied to these portions from a power source (not shown).

The radio wave detector portion 5 detects the strength of a radio signal from a road-side machine (not shown) by means of an antenna 11. The communication control portion 6 sends and receives data to and from the road-side machine by radio by means of the antenna 11. Together the CPU 2 and the radio wave detector portion 5 constitute a communication zone determining means for determining if the vehicle is within a toll collection communication zone by radio communication with the road-side machine.

Here, the "toll collection communication zone" is defined as the zone in which the radio wave detector portion 5 detects the strength of the radio signal from the road-side machine, confirms that the strength of the radio signal is sufficient for communication of toll collection data by the communication control portion 6 and the road-side machine, and determines that data communication with the road-side machine is possible.

The storage medium interface portion 4 sends and receives data to and from an IC card 20 which is a storage medium. The memory 7 stores the information necessary for toll collection between the road-side machine and the IC card 20. The card insertion detector switch 13 constitutes an insertion state detecting means for detecting if the storage medium has been correctly inserted into the vehicle-mounted unit 100.

The display portion 14 serves the function of conveying information to the driver, and may comprise a liquid-crystal display, for example. The display portion 14 may also comprise light emitting diodes, a voice generating device, etc.

The external control apparatus interface portion 101 sends and receives data to and from an external vehicle speed control device 30 for controlling the speed of the vehicle. The external control apparatus interface portion 101 is connected to the vehicle speed control device 30 being an external control apparatus, and together with the CPU 2, constitutes a data sending and receiving means for sending and receiving data to and from the external control apparatus.

Here, the vehicle speed control device 30 is mounted to the automobile together with the vehicle-mounted unit 100, and controls the vehicle such that the vehicle speed matches instructions from the driver or another external control device.

A storage medium insertion portion 12 for the insertion of the IC card 20 is also disposed in the vehicle-mounted unit 100 and is designed such that the IC card 20 can be removably inserted into the vehicle-mounted unit 100. When the IC card 20 is inserted into the storage medium insertion portion 12, the card insertion detector switch 13 is switched on and the CPU 2 receives a storage medium insertion confirmation signal.

A memory 22 capable of recording and holding the information necessary for toll collection, and a vehicle-mounted unit interface portion 21 for exchanging data with the storage medium interface portion 4 of the vehicle-mounted unit 100 are disposed on the IC card 20.

The CPU 2 constitutes a suitability determining means for determining whether the IC card 20 is suitable for toll collection from the data stored in the memory 22 on the IC card 20 and the data stored in the memory 7 in the vehicle-mounted unit 100. That is to say, a toll collection suitability check is performed by comparing the information, such as the user ID, the expiration date of the IC card 20, etc., stored in advance in the memory 22 of the IC card 20 with the information stored in the memory 7 of the vehicle-mounted unit 100 to confirm if the IC card 20 is suitable for toll collection.

Next, the operation of this embodiment of the present invention as shown in FIG. 1 will be explained with reference to the low chart in FIG. 2.

Figure 2:
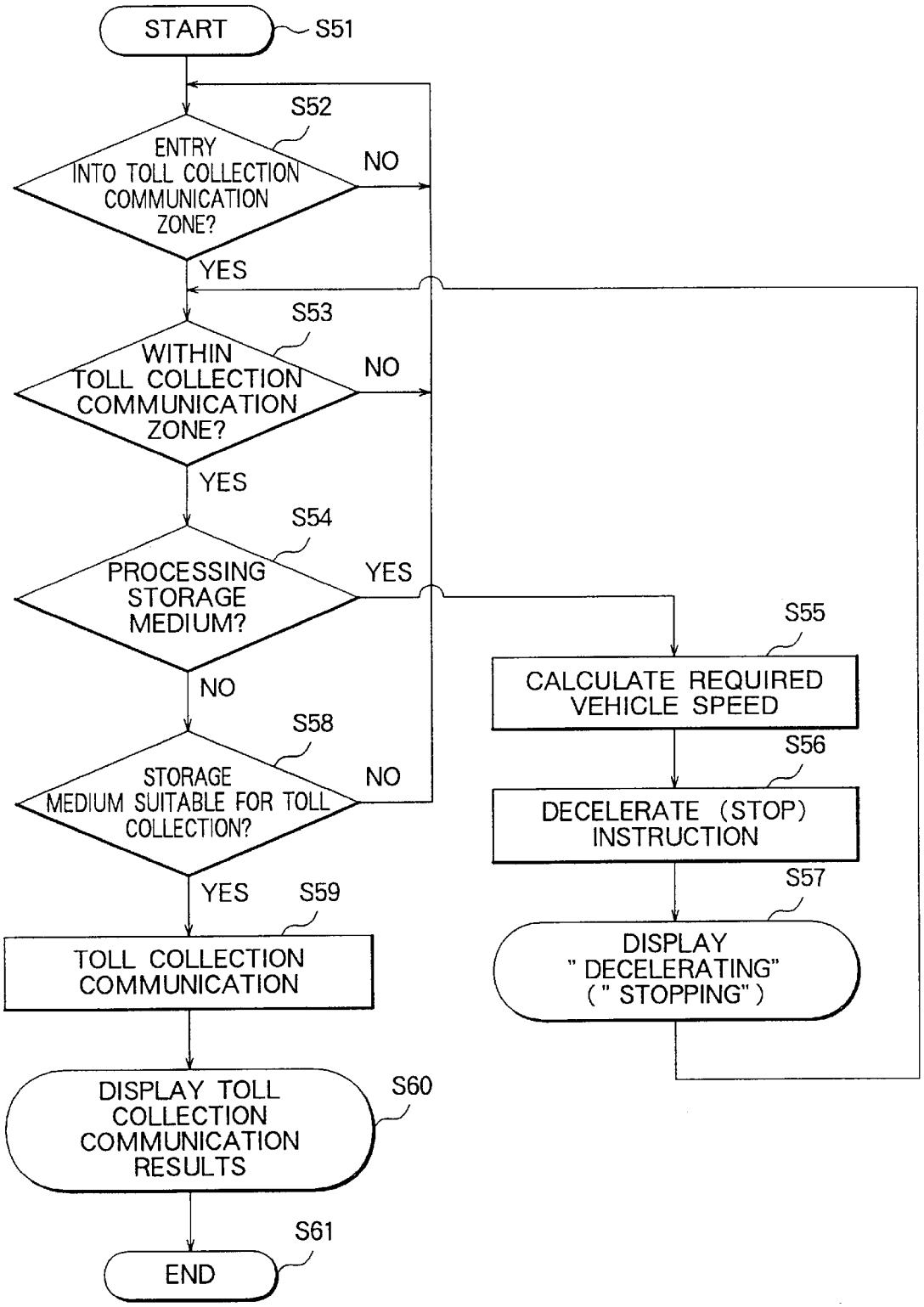
FIG. 2 is a flow chart showing the operation of Embodiment 1 of the present invention.

In FIG. 2, the vehicle-mounted unit 100 starts up when the vehicle power source is switched on (Step S51). The CPU 2 checks for a signal indicating that the vehicle-mounted unit is within a toll collection communication possible zone, and determines whether the vehicle mounted with the vehicle-mounted unit 100 has entered the toll collection communication zone (Step S52).

If the vehicle has not entered a toll collection communication zone, the process returns to Step S52.

On the other hand, if the vehicle has entered a toll collection communication zone, the vehicle is consequently deemed to be within a toll collection communication zone (Step S53). If the vehicle leaves the toll collection communication zone, the process returns to Step S52.

If the vehicle is within the toll collection communication zone, the CPU 2 determines whether the storage medium is being processed (Step S54). Here, "the storage medium is being processed" is defined as the state in which the IC card 20 has been correctly inserted into the storage medium insertion portion 12 of the vehicle-mounted unit 100 and the CPU 2 has received a storage medium insertion confirmation signal sent from the card insertion detector switch 13 being a storage medium insertion detector portion, and the CPU 2 is processing data from the storage medium interface portion 4 sent from the IC card 20 to the storage medium interface portion 4 to confirm the toll collection suitability of the IC card 20 and is not yet finished.

If the storage medium is being processed, a required vehicle speed calculation process is performed to calculate a required speed for decelerating the vehicle (Step S55).

In the required vehicle speed calculation process, the CPU 2 calculates a required vehicle speed Vr (kph) having as parameters an elapsed time from entry t (seconds) measured from the entry of the vehicle into the toll collection communication zone and a vehicle speed V (kph) on entry of the vehicle into the toll collection communication zone so as to enable the toll collection suitability check and toll collection to be completed within the toll collection communication zone. For example, the required speed may be determined by $Vr=V-\alpha t$ (where $\alpha$ is a coefficient). Furthermore, if the elapsed time from entry t exceeds a predetermined value, then $Vr=0$. Moreover, the vehicle speed V on entry of the vehicle into the toll collection communication zone can be obtained by the CPU from a vehicle-mounted unit interface portion 31 of the vehicle speed control device 30 by means of the external control apparatus interface portion 101.

The required speed calculated in Step S55 is indicated to the vehicle speed control device 30 by means of the external control apparatus interface portion 101 and the vehicle-mounted unit interface portion 31, and the vehicle is decelerated to the indicated speed by a vehicle speed control means (not shown) of the vehicle speed control device 30 (Step S56).

Furthermore, a message such as "decelerating", for example, is displayed by the display portion 14 to alert the driver that the vehicle will decelerate (Step S57).

Now, if the required speed Vr from Step S55 is 0 kph, the vehicle speed control device 30 is instructed to stop the vehicle (Step S56), and a message such as "stopping", for example, is displayed by the display portion 14 to alert the driver that the vehicle will stop (Step S57).

Thereafter, the process returns to Step S53, and if the storage medium is being processed at Step S54, Steps S55 onwards are processed continuously and the required speed Vr is indicated to the vehicle speed control device 30 in real-time.

On the other hand, if the processing of the storage medium has been completed at Step S54, the suitability of the IC card 20 for toll collection is determined from the results of the processing of the IC card 20 storage medium (Step S58).

Here, "toll collection suitability" is defined as being deemed that toll collection may be performed using the IC card 20 having compared the data stored in the memory 22 of the IC card 20 with the data stored in the memory 7 of the vehicle-mounted unit 100.

Here, data such as the user ID, the expiry date of the IC card 20, etc., for example, are compared.

If the IC card 20 is deemed to be suitable for toll collection, the communication control portion 6 performs a toll collection communication being the sending and receiving of toll collection data by radio to and from the road-side machine (not shown) by means of the antenna 11 (Step S59), the toll collection communication results such as the toll to be paid, etc., arc displayed in the display portion 14 (Step S60), and the toll collection routine ends (Step S61).

On the other hand, at Step S58, if the IC card 20 is deemed not to be suitable for toll collection, toll collection cannot be performed using the IC card 20 in that state and the process returns to Step S52.

Figure 3:
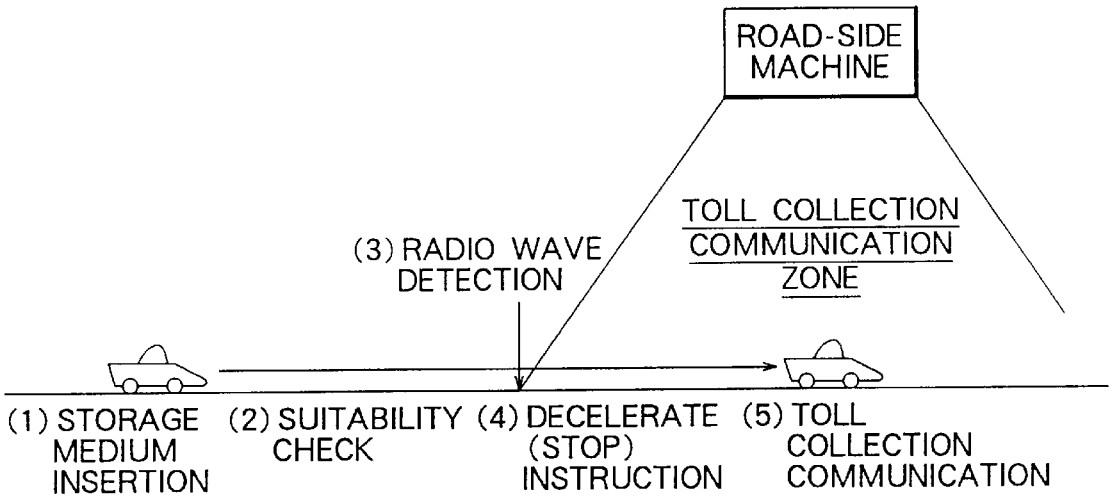
FIG. 3 is a conceptual diagram showing an example of the operation of Embodiment 1 of the present invention.
Figure 4:
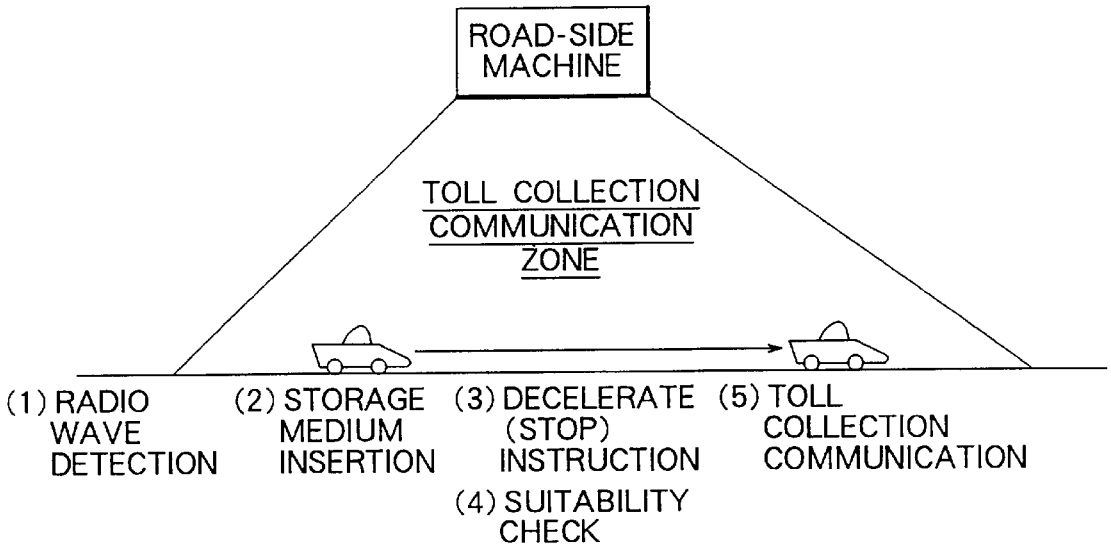
FIG. 4 is a conceptual diagram showing another example of the operation of Embodiment 1 of the present invention.

FIGS. 3 and 4 are conceptual diagrams showing examples of the operation of Embodiment 1 above. FIG. 3 shows a case where it is determined that the vehicle has entered a toll collection communication zone by the detection of radio waves by a radio wave detector portion 5 when an IC card 20 being a storage medium has been inserted and the toll collection suitability of the IC card 20 is being confirmed. In this case, a deceleration or stop instruction is sent to the vehicle speed control device. If toll collection suitability is confirmed, toll collection communication is performed between the road-side machine and the vehicle-mounted unit 100.

FIG. 4 shows a case where the IC card 20 has not been inserted into the vehicle-mounted unit 100 when it is determined that the vehicle has entered a toll collection communication zone by the detection of radio waves by a radio wave detector portion 5, and the IC card 20 is inserted into the vehicle-mounted unit 100 thereafter. In this case, a deceleration or stop instruction is sent to the vehicle speed control device 30. If toll collection suitability is confirmed after that, toll collection communication is performed between the road-side machine and the vehicle-mounted unit 100.

In this manner, if the IC card has not been correctly inserted into the vehicle-mounted unit 100 or toll collection suitability cannot be confirmed when the vehicle-mounted unit 100 is within a toll collection communication zone, because data for decelerating the vehicle is designed to be sent to the vehicle speed control device 30 and the vehicle is decelerated by the vehicle speed control device 30, toll collection can be reliably performed even if insertion of the IC card 20 by the driver is delayed.

Embodiment 2

Figure 5:
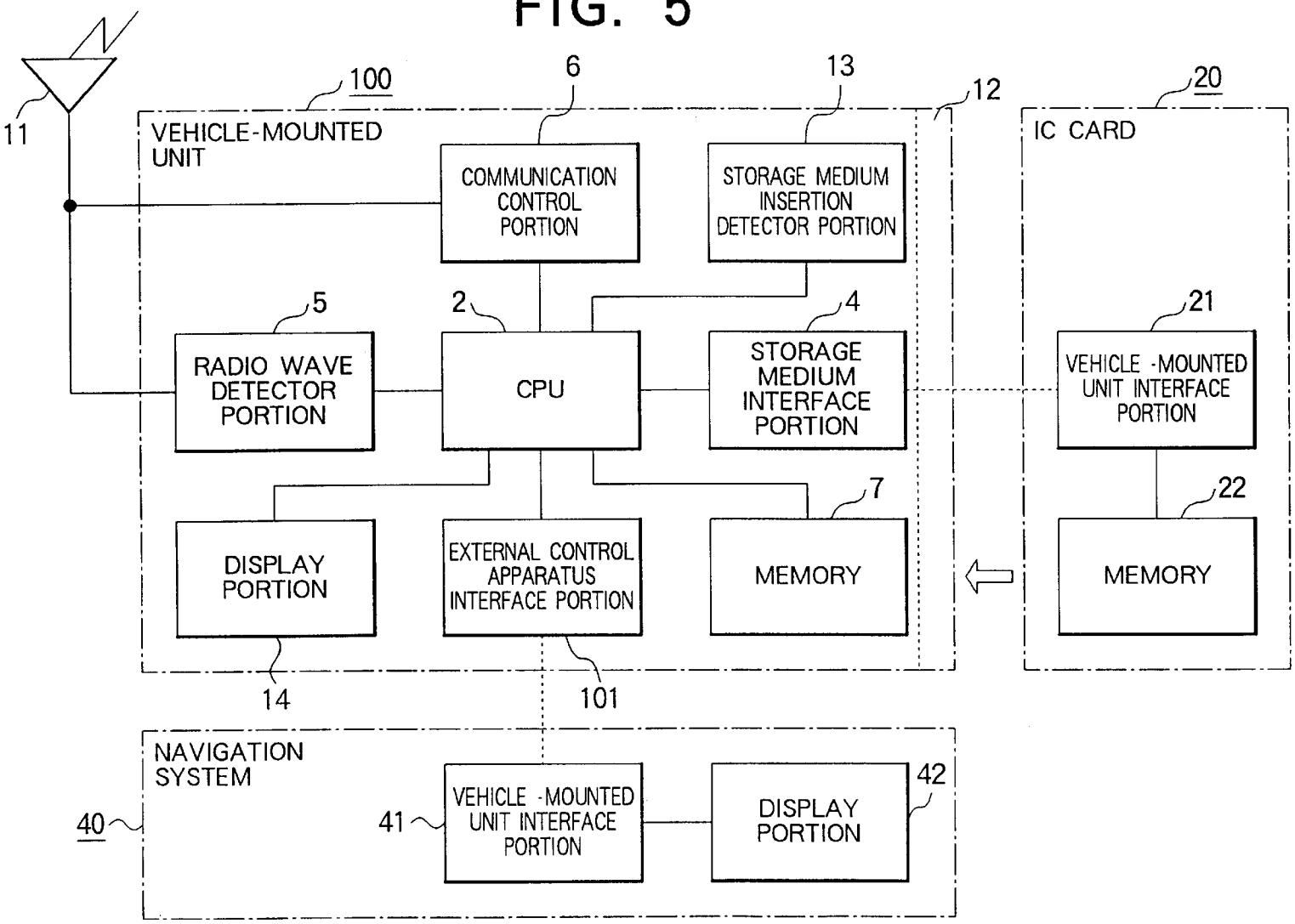
FIG. 5 is a block diagram showing the functional construction of the periphery of a vehicle-mounted unit for a toll collection system according to Embodiment 2 of the present invention.

Embodiment 2 of the present invention will be explained below with reference to the drawings. FIG. 5 is a block diagram showing the functional construction of the periphery of a vehicle-mounted unit mounted to an automobile in a toll collection system according to Embodiment 2 of the present invention. FIG. 5 differs from FIG. 1 in that a navigation system 40 is connected to the vehicle-mounted unit 100 as an external control apparatus.

The navigation system 40 is mounted to an automobile mounted with a vehicle-mounted unit 100. A vehicle-mounted unit interface portion 41 for sending and receiving data to and from the vehicle-mounted unit 100 is disposed in the navigation system 40. Furthermore, a display portion 42 for displaying the position of the automobile mounted with the navigation system 40 on a map is disposed in the navigation system 40. The required vehicle speed Vr from Embodiment 1 is also displayed in the display portion 42.

Next, the operation of this embodiment of the present invention as shown in FIG. 5 will be explained with reference to the flow chart in FIG. 6.

Figure 6:
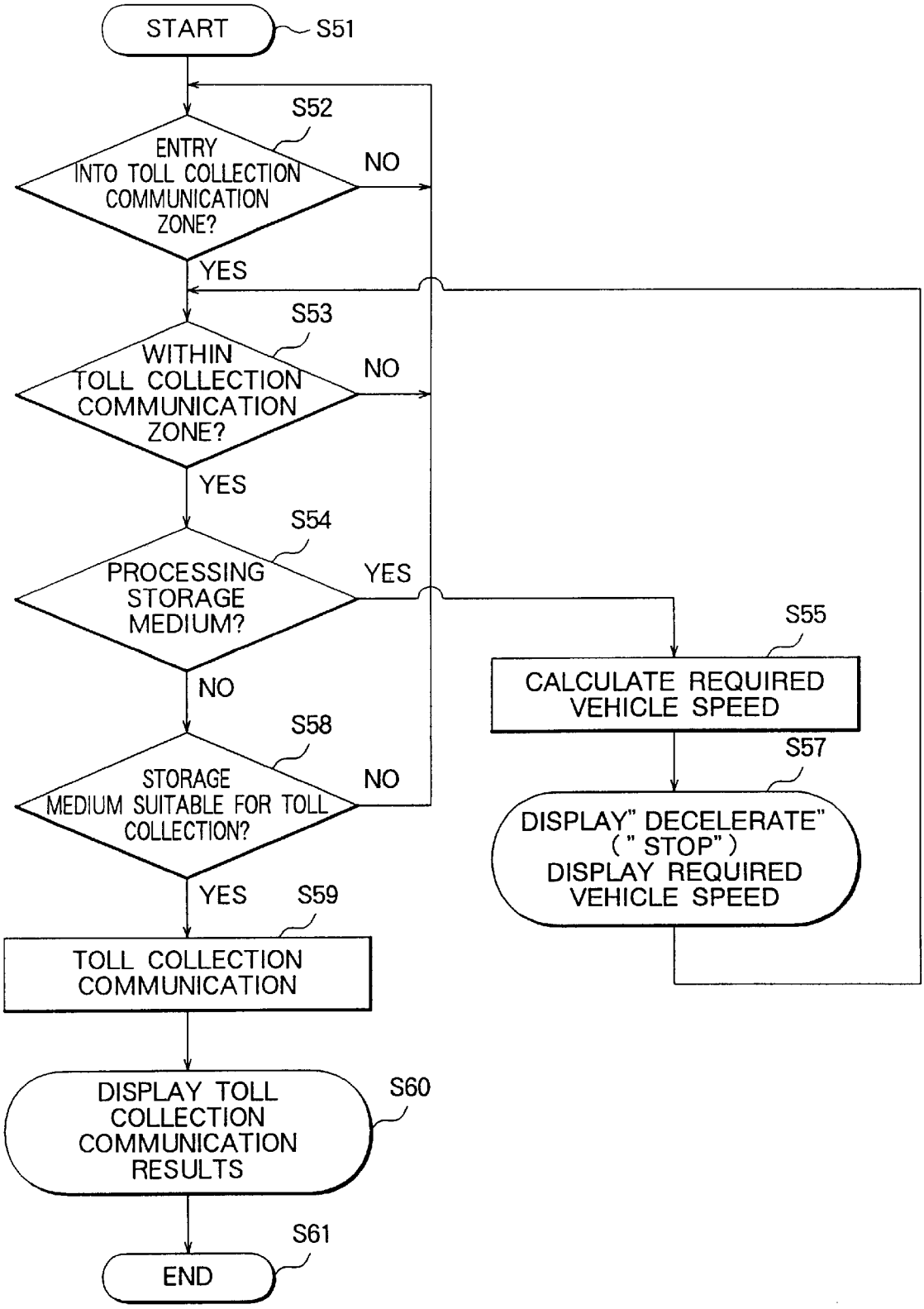
FIG. 6 is a flow chart showing the operation of Embodiment 2 of the present invention.

FIG. 6 differs from FIG. 2 in that there is no Step S56 being the deceleration or stop instruction to the vehicle speed control device 30 in FIG. 2. Hereinafter, only those portions differing from Embodiment 1 will be explained; duplicate explanations will be omitted.

When the vehicle is within a toll collection communication zone (Steps S52 and S53), the CPU determines whether the storage medium is being processed (Step S54), and if the storage medium is being processed, a required vehicle speed calculation process is performed to calculate a required speed Vr for decelerating the vehicle (Step S55).

Here, because the length of the toll collection communication zone is known in advance, the required vehicle speed calculation process calculates a required vehicle speed Vr (kph) having as parameters an elapsed time from entry t (seconds) measured from the entry of the vehicle into the toll collection communication zone and a vehicle speed V (kph) on entry of the vehicle into the toll collection communication zone so as to enable the toll collection suitability check and toll collection to be completed within the toll collection communication zone. For example, the required speed may be determined by $Vr=V-\alpha t$ (where $\alpha$ is a coefficient).

Furthermore, if the elapsed time from entry t exceeds a predetermined value, then the required vehicle speed Vr=0 kph. In addition, because the navigation system 40 has information concerning the exact position of the vehicle within the toll collection communication zone, the required vehicle speed Vr=0 kph may be set at an earlier position being a predetermined distance before the position at which the vehicle passes out of the toll collection communication zone completely, regardless of the elapsed time from entry t.

Moreover, information concerning the vehicle speed V on entry of the vehicle into the toll collection communication zone and its exact position within the toll collection communication zone can be obtained by the CPU 2 from the vehicle-mounted unit interface portion 41 of the navigation system 40 by means of the external control apparatus interface portion 101.

Next, a message such as "decelerate", for example, is displayed by the display portion 14 to urge the driver to decelerate the vehicle, and at the same time the required vehicle speed Vr is displayed in the display portion 42 of the navigation system 40 (Step S57).

Because the navigation system 40 is connected to the vehicle-mounted unit 100 in this manner, instructions to decelerate or stop the vehicle can be given to the driver using the display portion 42 of the navigation system 40 and toll collection can be reliably performed even if insertion of the storage medium by the driver is delayed.

Embodiment 3

Figure 7:
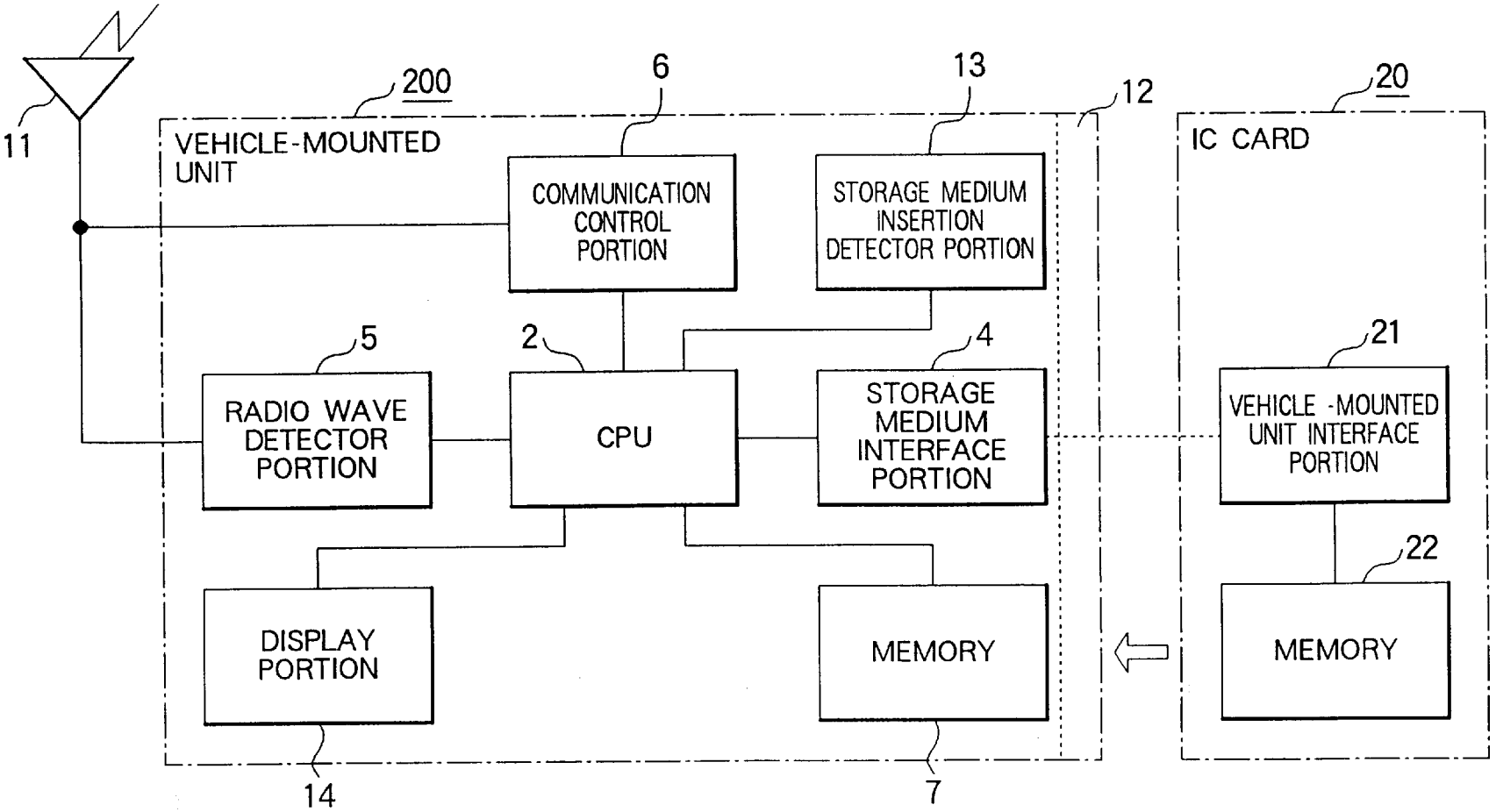
FIG. 7 is a block diagram showing the functional construction of the periphery of a vehicle-mounted unit for a toll collection system according to Embodiment 3 of the present invention.

Embodiment 3 of the present invention will be explained below with reference to the drawings. FIG. 7 is a block diagram showing the functional construction of the periphery of a vehicle-mounted unit 200 mounted to an automobile in a toll collection system according to Embodiment 3 3 of the present invention. The content displayed in the display portion 14 in Embodiment 3 differs from the conventional example in FIG. 9.

Here, the display portion 14 constitutes a display means activated in response to a communication zone determining means, an insertion state detecting means, and a suitability determining means.

Next, the operation of this embodiment of the present invention will be explained with reference to the flow chart in FIG. 8.

Figure 8:
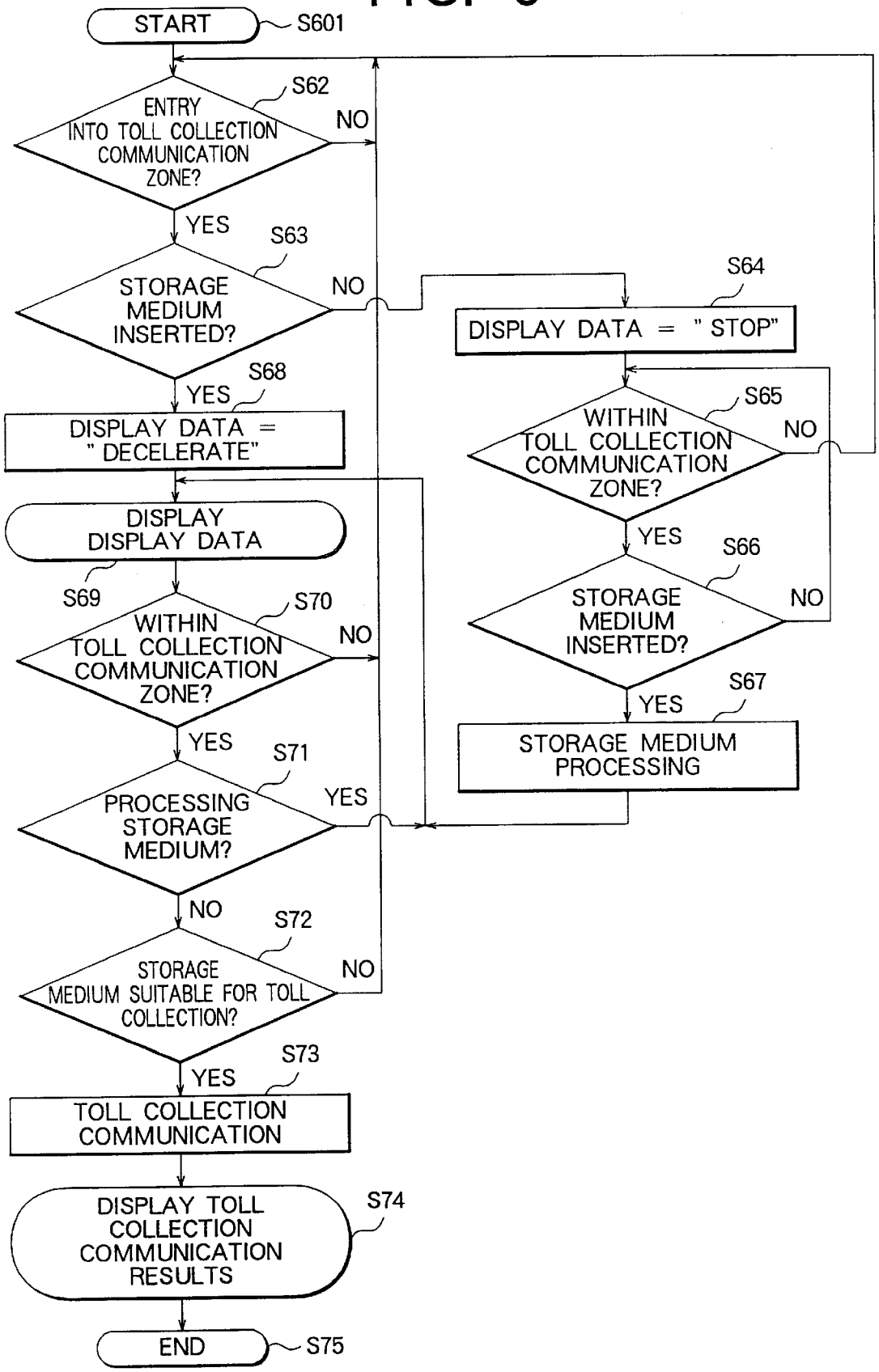
FIG. 8 is a flow chart showing the operation of Embodiment 3 of the present invention.

In FIG. 8, the vehicle-mounted unit 200 starts up when the vehicle power source is switched on (Step S601). The CPU 2 determines whether the vehicle has entered a toll collection communication zone by checking for a signal indicating being within a toll collection communication zone (Step S62).

If the vehicle has not entered the toll collection communication zone, the process returns to Step S62.

On the other hand, if the vehicle has entered the toll collection communication zone, a storage medium insertion determination is performed to determine whether an IC card 20 being a storage medium has been correctly inserted into the storage medium insertion portion 12 of the vehicle-mounted unit 200 (Step S63). In this storage medium insertion determination, the CPU 2 screens a storage medium insertion confirmation signal sent from the card insertion detector switch 13, and if the IC card 20 has been correctly inserted into the storage medium insertion portion 12 of the vehicle-mounted unit 200, the card insertion detector switch 13 has been switched on, and insertion of the storage medium has been confirmed, the process proceeds to Step S68. At Step S68, "decelerate" data is temporarily stored in the memory 7 as data to be displayed in the display portion 14.

On the other hand, if insertion of the IC card 20 is being confirmed, "stop" data is temporarily stored in the memory 7 as data to be displayed in the display portion 14 (Step S64). Next, it is determined whether the vehicle is still within the toll collection communication zone (Step S65). If the vehicle has left the toll collection communication zone, the process returns to Step S62.

If the vehicle is within the toll collection communication zone, the same storage medium insertion determination as in Step S63 is performed again (Step S66). If the card insertion detector switch 13 is on and insertion of the storage medium has been confirmed, the process proceeds to Step S67.

On the other hand, if insertion of the IC card 20 is being confirmed, the process returns to Step S65.

At Step S67, because the card insertion detector switch 13 has already been switched on, the CPU 2 processes the storage medium to confirm the toll collection suitability of the IC card 20 based on data from the storage medium interface portion 4 sent from the IC card 20 to the storage medium interface portion 4, and the process proceeds to Step S69.

At Step S69, the display data stored in the memory 7 is displayed in the display portion 14. The content displayed in the display portion 14 differs according to the determination in Step S63, and if the storage medium has been inserted when the vehicle enters the toll collection communication zone, the process proceeds from Step S63 to Step S68, and "decelerate" is displayed in the display portion 14.

On the other hand, if the storage medium has not been inserted when the vehicle enters the toll collection communication zone, "stop" is displayed in the display portion 14 because the process has passed through Step S64.

With "decelerate" or "stop" still displayed in the display portion 14, it is determined whether the vehicle is still in the toll collection communication zone (Step S70).

If the vehicle has left the toll collection communication zone, the process returns to Step S62.

If the vehicle is within the toll collection communication zone, the CPU determines whether the storage medium is being processed (Step S71).

If the storage medium is being processed, the process returns to Step S69 and the data display continues.

On the other hand, at Step S71, if the processing of the storage medium has been completed, the CPU determines whether the IC card 20 is suitable for toll collection from the results of the processing of the IC card 20 storage medium (Step S72).

If the IC card 20 is deemed to be suitable for toll collection, the communication control portion 6 performs a toll collection communication being the sending and receiving of toll collection data by radio to and from the road-side machine (not shown) by means of the antenna 11 (Step S73), the toll collection communication results such as the toll to be paid, etc., are displayed in the display portion 14 (Step S74), and the toll collection routine ends (Step S75).

On the other hand, at Step S72, if the IC card 20 is determined not to be suitable for toll collection, toll collection cannot be performed using the IC card 20 in that state and the process returns to Step S62.

In this manner, instructions to decelerate or stop the vehicle can be given to the driver using the display portion 14 of the vehicle-mounted unit 200 displaying the toll collection communication results, and toll collection can be reliably performed even if insertion of the storage medium by the driver is delayed. Furthermore, because the time required for processing the storage medium after entry into the toll collection communication zone depends on the processing state of the storage medium which is related to insertion of the storage medium and toll collection suitability, toll collection can be accurately performed within the toll collection communication zone by altering the display content.

Moreover, in Embodiment 2, at Step S57, the display urging the driver to decelerate the vehicle was displayed in the display portion 14 of the vehicle-mounted unit 100, but the destination of the display may also be the display portion 42 of the navigation system 40.

In Embodiments 1 to 3, the display alerting the driver that the vehicle will decelerate or urging the driver to decelerate the vehicle may be performed by voice.

In the above manner, according to claim 1 of the present invention, the vehicle-mounted unit for a toll collection system is a vehicle-mounted unit for a toll collection system for performing radio communication with a road-side machine and automatically charging a toll based on information in a storage medium removably inserted into the vehicle-mounted unit comprising:

a communication zone determining means for determining if the vehicle is within a toll collection communication zone by radio communication with the road-side machine;

an insertion state detecting means for detecting if the storage medium has been correctly inserted into the vehicle-mounted unit;

a suitability determining means for determining if the storage medium is suitable for toll collection; and a data sending and receiving means connected to an external control apparatus for sending and receiving data signals to and from the external control apparatus, the data sending and receiving means sending data to the external control apparatus for decelerating the vehicle if the vehicle-mounted unit is within a toll collection communication zone and the storage medium has not been correctly inserted into the vehicle-mounted unit or toll collection suitability cannot be confirmed, and since by connection to an external control apparatus, the vehicle can be decelerated by the external control apparatus itself or by the action of the driver, the driver's mental state is not confused even if the insertion of the storage medium by the driver is delayed, providing a toll collection system enabling reliable toll collection performance.

According to Claim 2 of the present invention, the vehicle-mounted unit for a toll collection system is that of Claim 1 wherein the data sent from the data sending and receiving means includes a required speed for the vehicle, whereby a vehicle speed enabling reliable toll collection can be conveyed by means of an external control apparatus to the external control apparatus itself or to the driver, providing a toll collection system enabling more reliable toll collection performance even if the insertion of the storage medium by the driver is delayed.

According to Claim 3 of the present invention, the vehicle-mounted unit for a toll collection system is that of Claim 1 or 2 wherein the external control apparatus comprises a vehicle speed control device, providing a toll collection system in which the speed of the vehicle is controlled so as to enable more reliable toll collection performance.

According to Claim 4 of the present invention, the vehicle-mounted unit for a toll collection system is that of Claim 1 or 2 wherein the external control apparatus comprises a navigation system, whereby the driver controls the speed of the vehicle in accordance with instructions from the navigation system, providing a toll collection system enabling more reliable toll collection performance.

According to Claim 5 of the present invention, the vehicle-mounted unit for a toll collection system is a vehicle-mounted unit for a toll collection system for performing radio communication with a road-side machine and automatically charging a toll based on information in a storage medium removably inserted into the vehicle-mounted unit comprising:

a communication zone determining means for determining if the vehicle is within a toll collection communication zone by radio communication with the road-side machine;

an insertion state detecting means for detecting if the storage medium has been correctly inserted into the vehicle-mounted unit;

a suitability determining means for determining if the storage medium is suitable for toll collection; and a display means activated in response to the communication zone determining means, the insertion state detecting means, and the suitability determining means, the display means performing a display urging the driver to decelerate the vehicle if the vehicle-mounted unit is within a toll collection communication zone and the storage medium has not been correctly inserted into the vehicle-mounted unit or toll collection suitability cannot be confirmed, whereby an appropriate vehicle speed action can be conveyed to the driver, providing a toll collection system enabling more reliable toll collection performance.

According to Claim 6 of the present invention, the vehicle-mounted unit for a toll collection system is that of Claim 5 wherein the display means performs a display urging the driver to stop the vehicle if the storage medium is correctly inserted into the vehicle-mounted unit after the vehicle has entered the toll collection communication zone, an appropriate vehicle speed action in response to the time required to confirm the suitability of the storage medium for toll collection can be conveyed to the driver, providing a toll collection system enabling more reliable toll collection performance.

What is claimed is:

1. A vehicle-mounted unit for a toll collection system for performing radio communication with a road-side machine and automatically charging a toll based on information in a storage medium removably inserted into said vehicle-mounted unit comprising:

a communication zone determining means for determining if said vehicle is within a toll collection communication zone by radio communication with said road-side machine;

an insertion state detecting means for detecting if said storage medium has been correctly inserted into said vehicle-mounted unit;

a suitability determining means for determining if said storage medium is suitable for toll collection; and a data sending and receiving means connected to an external control apparatus for sending and receiving data signals to and from said external control apparatus, said data sending and receiving means sending data to said external control apparatus for decelerating said vehicle if said vehicle-mounted unit is within a toll collection communication zone and is confirming if said storage medium is correctly inserted into said vehicle-mounted unit or is confirming toll collection suitability.

2. The vehicle-mounted unit for a toll collection system according to claim 1 wherein said data sent from said data sending and receiving means includes a required speed for said vehicle.

3. The vehicle-mounted unit for a toll collection system according to claim 2 wherein said external control apparatus comprises a vehicle speed control device.

4. The vehicle-mounted unit for a toll collection system according to claim 2 wherein said external control apparatus comprises a navigation system.

5. The vehicle-mounted unit for a toll collection system according to claim 1 wherein said external control apparatus comprises a vehicle speed control device.

6. The vehicle-mounted unit for a toll collection system according to claim 1 wherein said external control apparatus comprises a navigation system.

7. A vehicle-mounted unit for a toll collection system for performing radio communication with a road-side machine and automatically charging a toll based on information in a storage medium removably inserted into said vehicle-mounted unit comprising:

a communication zone determining means for determining if said vehicle is within a toll collection communication zone by radio communication with said road-side machine;

an insertion state detecting means for detecting if said storage medium has been correctly inserted into said vehicle-mounted unit;

a suitability determining means for determining if said storage medium is suitable for toll collection; and a display means activated in response to said communication zone determining means, said insertion state detecting means, and said suitability determining means, said display means performing a display urging the driver to decelerate said vehicle if said vehicle-mounted unit is within said toll collection communication zone and is confirming if said storage medium is correctly inserted into said vehicle-mounted unit or is confirming toll collection suitability.

8. The vehicle-mounted unit for a toll collection system according to claim 7 wherein said display means performs a display urging said driver to stop said vehicle if said storage medium is correctly inserted into said vehicle-mounted unit after said vehicle has entered said toll collection communication zone.

* * * * *